US005510951A

United States Patent [19]

Briedis et al.

[11] Patent Number: 5,510,951

[45] Date of Patent: Apr. 23, 1996

[54] ELECTRONIC CONTROL FOR 3-WIRE DC COILS

[75] Inventors: Gunars Briedis, Milwaukee; Jerome K. Hastings, Sussex; Michael R. Scharnick, Brookfield, all of Wis.

[73] Assignee: Eaton Corporation, Cleveland, Ohio

[21] Appl. No.: 283,464

[22] Filed: Aug. 1, 1994

[51] Int. Cl.[6] ..... H01H 47/04

[52] U.S. Cl. ..... 361/154; 361/210

[58] Field of Search ..... 361/152–155, 361/173, 174, 203, 210; 307/100

[56] References Cited

U.S. PATENT DOCUMENTS

| | | | |
|---|---|---|---|
| 3,453,569 | 7/1969 | Ostby | 335/132 |
| 3,737,736 | 6/1973 | Stampfli | 361/154 |
| 4,475,094 | 10/1984 | Grenier et al. | 335/139 |
| 4,812,945 | 3/1989 | D'Onofrio | 361/154 |

*Primary Examiner*—Fritz Fleming
*Attorney, Agent, or Firm*—Larry G. Vande Zande

[57] ABSTRACT

A contactor has an armature, a pull-in coil and a holding coil. When the system is energized through a first switch such as a thermostat, the low current holding coil is energized in preparation for holding the armature pulled in after the pull-in coil is energized and the armature has finished its power stroke. A solid-state switching device and the pull-in coil are connected in series between both terminals of a power source. A control circuit causes the solid-state switching device to be conductive the instant power is supplied to the circuit through the first switch. One embodiment of the control circuit is based on logic gates. RC circuits associated with the gates keep the solid-state switching device and pull-in coil conducting long enough for the armature to pull-in. After the solid-state switching device turns on, the transistor is controlled to turn off, deenergizing the pull-in coil while the holding coil holds the armature in until the first switch opens and power input is discontinued. Another embodiment, based on a programmable timer, delivers current pulses to the pull-in coil at uniform periodicity until the armature is pulled in. After the armature is pulled in, pulse signals are shunted from the solid-state switching device so it turns off, and current pulses through the pull-in coil are discontinued, while the holding coil holds the armature in pulled-in condition until the first switch is opened.

6 Claims, 4 Drawing Sheets

ELECTRONIC CONTROL FOR 3-WIRE DC COILS

BACKGROUND OF THE INVENTION

The invention disclosed herein pertains to an electronic controller for controlling a multiple electric power level load. The controller is especially useful for controlling an electromagnetically operated contactor that is characterized by having a magnetically attractable armature associated with a high current coil that pulls in the armature to close an electric circuit and a low current relatively high impedance holding coil that holds the armature in pulled-in condition.

Contactors of this general type are often used, together with mechanical, slow-acting switches, to energize or connect to a power source an electric motor that drives a refrigeration compressor. An example of a critical usage is in association with a refrigeration system on a semi-trailer truck where the power for operating the contactor is derived from the battery of the tractor that hauls the trailer, or a battery located on the trailer itself. As is known, the battery has a nominal or rated output voltage of 12 volts. The voltage can be much lower when the battery is partially discharged or the load on the battery other than the refrigeration compressor load is high. It is of critical importance having the refrigeration motor controlling contactor pull in when the thermostat calls for cooling, even if the voltage of the electrical system is substantially below nominal voltage. Failure of the contactor to pull in at low voltage can result in no refrigeration in the trailer and spoilage of a load of perishables.

In addition, failure of the contactor to pull in at low voltage can result in current being continuously passed through the pull-in coil without the armature closing and opening the normally-closed switch to the high current coil, with the undesirable result that the coil can be damaged or the battery further discharged.

This invention relates to improvements to the above apparatus and to solutions to some of the problems raised or not solved thereby.

SUMMARY OF THE INVENTION

The new controller is illustrated herein as controlling a contactor that has a high current carrying pull-in coil and a low current carrying holding coil. The impedance of the pull-in coil is purposely designed to be low so that even if the system input voltage is low sufficient current will flow for developing a magnetic field strong enough to pull in the armature. The pull-in coil would burn out if the high current were sustained. Hence, the controller only keeps the pull-in coil energized for a number of milliseconds that are required for the armature to execute its power stroke. Then the controller deenergizes the pull-in coil, but the holding coil remains energized at a low current level. If the controller is being used in a truck refrigeration system, the holding coil will ultimately be deenergized when the thermostat opens, the armature thus dropping out as a result of cooling conditions in the trailer having been satisfied.

The manner in which the foregoing features of the invention are achieved and implemented will appear in the more detailed description of a preferred embodiment of the invention which will now be set forth in reference to the drawings.

DESCRIPTION OF A PREFERRED EMBODIMENT

Figure 1:
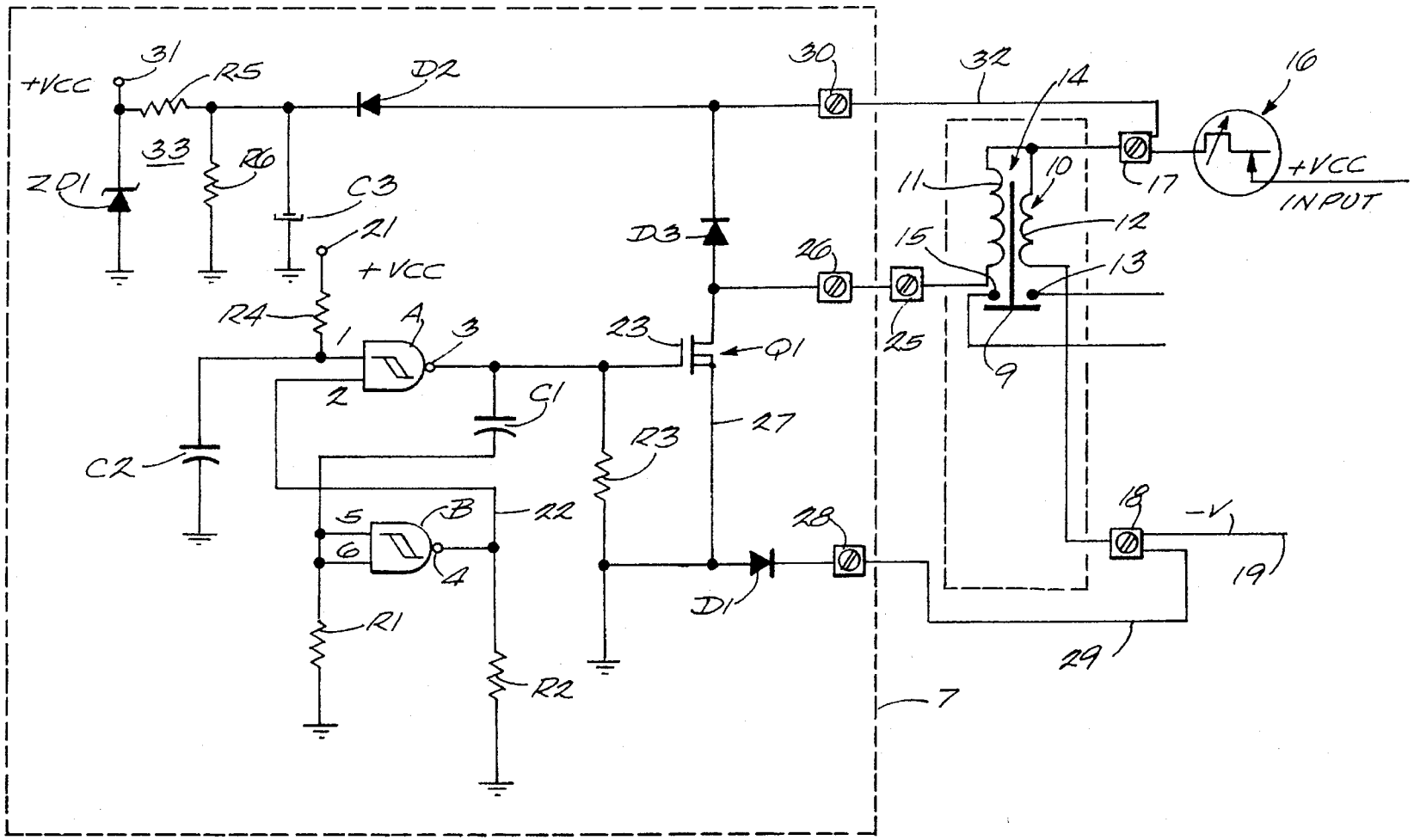
FIG. 1 shows a circuit diagram of the new controller and a contactor controlled thereby.

FIG. 1 is a circuit diagram of a controller 7, which controls energization of electromagnetic pull-in coil 11 and electromagnetic holding coil 12 of a contactor 10. The contactor 10 has a magnetizable armature 14 that is pulled in by the magnetic field developed by energization of coils 11 and 12 for connecting stationary contacts 13 and 15 with a movable contact 9. Coil 11 is characterized as a pull-in coil which is supplied by the controller 7 with a current pulse of sufficient magnitude and duration to pull the contactor 10 into circuit closing position. In an actual embodiment, by way of example and not limitation, the pull-in pulse may have a duration of about 100 ms, but this can be varied in accordance with the power requirements for operating a particular contactor. An electric motor, not shown, for a refrigeration compressor, may be controlled by contactor 10, by way of example.

The controller 7 is supplied with electric power through a first switching device such as a thermostat 16 which responds to a temperature rise above a preset limit in the refrigerated environment of, for example, a semi-trailer that hauls perishables. The current is supplied by closing and connecting the controller 7 to a power source such as the battery of the semi-trailer tractor that has a refrigerated trailer, or the trailer itself may have such a battery. As will be discussed later, the circuit of FIG. 1 may also be used in a case where the input power through the thermostat 16 is full wave rectified direct current derived from an alternating current source.

In the illustrated embodiment, dc voltage is supplied from one terminal of the 12 v battery, not shown, to the thermostat 16. When the thermostat 16 closes, the battery voltage appears on terminal 17. Thus, contactor holding coil 12 is energized with current flowing from terminal 17 through coil 12 and to terminal 18 which connects to the negative side of the battery by way of a conductor 19. The impedance of holding coil 12 is relatively high, so the magnetic field created by its energization is insufficient to pull in a contactor, although it is sufficient to hold the contactor in a pulled-in condition after the other high current coil 11 has pulled the contactor in. In accordance with the invention, a short duration high level current pulse is passed through coil 11 to pull in contactor 10 in response to thermostat 16 becoming conductive.

There are times when the voltage on the vehicle electrical system is low because there is presently heavy current draw due to headlights and other appliances on the vehicle being energized, or because the engine has been shut down for an extended period so that the battery is less than fully charged due to the vehicle alternator having not run for a long time. Under certain circumstances, system voltage can drop to a level which is not sufficient to operate a pull-in coil that is designed for operating at 12 volts. Hence, according to the invention, the pull-in coil 11 is designed for developing a sufficiently strong magnetic field to pull in the contactor armature at a voltage that is substantially below nominal system voltage. For example, the controller 7 is designed so that it will effect pull-in of the contactor 10 armature 14 if the voltage applied to the contactor is about two-thirds of rated nominal dc voltage. By way of example and not limitation, in a nominally 12-volt system, the coil 11 will pull in armature 14, according to the invention, when a voltage of eight volts is applied to it. This assures that the refrigerator compressor motor will turn on when the thermostat 16 calls for refrigeration even though system voltage is low.

When the supply voltage is applied to input terminal 17 of the contactor 10 through the thermostat 16, the supply voltage $V_{CC}$ also appears at terminal 21, although the conductor between terminals 17 and 21 is omitted from the FIG. 1 diagram.

The controller 7 circuit includes NAND gates A and B. Resistors in the circuit will hereafter be designated by the letter R followed by a reference numeral, capacitors by the letter C followed by a numeral, diodes by the letter D followed by a numeral and zener diodes by ZD and a numeral, the transistors by Q followed by a numeral, and the terminals of the gates A and B will be identified as pins with a number for the sake of brevity.

The structure and functions of the FIG. 1 controller circuit will be described concurrently. The NAND gates A and B have inputs with Schmitt trigger characteristics, so the gates change output states when their inputs make a voltage transition above or below a predetermined threshold voltage magnitude. When thermostat 16 conducts, current flows through resistor R4 to begin charging capacitor C2. Until capacitor C2 is charged to a voltage governed by the time constant of R4, C2, input pin 1 of gate A is at a low logical level, and output pin 3 is at a high logical level since the output pin 3 of a NAND gate only goes low when both input pins 1 and 2 swing to high logical level. Hence, while capacitor C2 is not yet fully charged, output pin 3 of gate A is at a high logical level or at positive polarity at this time.

Because pin 3 of gate A is high or positive, capacitor C1 begins to charge in series with resistor R1. The high flow of current through resistor R1 when capacitor C1 begins to charge results in a positive voltage drop across resistor R1, thus, making input pins 5 and 6 of gate B positive. Since both input pins 5 and 6 are positive or at a high logical level, output pin 4 of gate B is at a low logical level, that is, grounded through resistor R2. This low logical signal is transmitted through line 22 to input pin 2 of gate A, because while capacitor C1 is still charging, capacitor C2 has already charged to the voltage $V_{CC}$, which may be only eight volts. This means that input pin 1 of gate A is high, and input pin 2 is low, so the output pin 3 of gate A is still high, thereby developing a voltage drop across resistor R3. The voltage drop across R3 results in the application of a positive voltage pulse to the gate electrode 23 of a field effect transistor Q1, causing it to conduct between its source and drain. Conduction by transistor Q1 energizes pull-in coil 11, and contactor 10 closes, for actuating the refrigeration system. When transistor Q1 conducts, current flows from power input terminal 17, through pull-in coil 11, terminals 25 and 26, transistor Q1, line 27, diode D1, terminal 28, jumper 29, terminal 18 and line 19 to the negative side of the battery. Diode D1 protects controller 7 from reverse voltage application to the controller.

The duration of the current pulse through the pull-in coil is governed by a time constant determined by the values of capacitor C1 and resistor R1, which values can be selected by a knowledgeable circuit designer for compatibility with the rating of contactor 10. By way of example and not limitation, in a commercial embodiment, the current pulse width or duration for pull-in coil 11 is about 100 ms which is sufficient for the armature 14 of the contactor 10 to complete its circuit closing stroke. The magnitude of the current pulse through pull-in coil 11 can be high, since during its short duration there is no significant thermal gain in the coil 11. Holding coil 12, having been energized when the thermostat first conducted, holds the contactor pulled in.

As stated, the R1-C1 time constant governs the duration of the current pulse to the pull-in coil 11. As remarked above, since input pin 1 of NAND gate A becomes positive as capacitor C2 charged quickly and pin 2 received the low logical level signal from output pin 4 of NAND gate B, output pin 3 of gate A is positive while capacitor C1 is still charging and current is flowing through coil 11. The current pulse ends when capacitor C1 becomes charged. When capacitor C1 is charged, there is no more current flow through resistor R1 so input pins 5 and 6 of NAND gate B go to ground or a logical low level. With both inputs 5 and 6 low, the output pin 4 of gate B goes to a logical high level. This high logical level signal is transmitted by line 22 to input pin 2 of NAND gate A. Now, with both inputs 1 and 2 of NAND gate A high, output 3 of gate A swings to a low logical level and is grounded through resistor R3. Thus, the voltage on gate 23 of field effect transistor Q1 goes low and conduction by the transistor ends, thereby ending the current pulse through the pull-in coil 11.

There are other applications for the controller and contactor, especially applications that are not on vehicles or other sites that do not have a battery available as a power supply. In such applications, the controller and contactor may be supplied from a rectifier, not shown, having an ac input and full wave pulsating unfiltered dc output. This is conducted through thermostat 16 as is the case when steady state power is supplied from a battery. The diagram of FIG. 1 includes a suitable filter circuit 33, thereby allowing the customer the option of using a battery or rectifier output for the power supply.

As shown in FIG. 1, the filter circuit starts at input terminal 17 which is connected by means of a jumper 32 to a terminal 30 of the controller which connects to the anode of a diode D2. The filter circuit 33 is comprised of an electrolytic capacitor C3 and resistors R5 and R6 such that during operation of the device, smoothed dc current is available out of terminal 31($+V_{CC}$) for energizing the pulsing circuit containing NAND gates A and B as described above. A zener diode ZD1 is provided as a voltage regulator or limiter. Smoothing of the full wave rectified dc waveform is desirable in order to eliminate voltage peaks, spikes and transients that might cause false or variable triggering of NAND gates A and B. When operating in the rectified dc mode, a jumper, not shown, connects smoothed dc output terminal 31 to terminal 21, and there is no direct connection between terminal 21 and input terminal 17.

Figure 2:
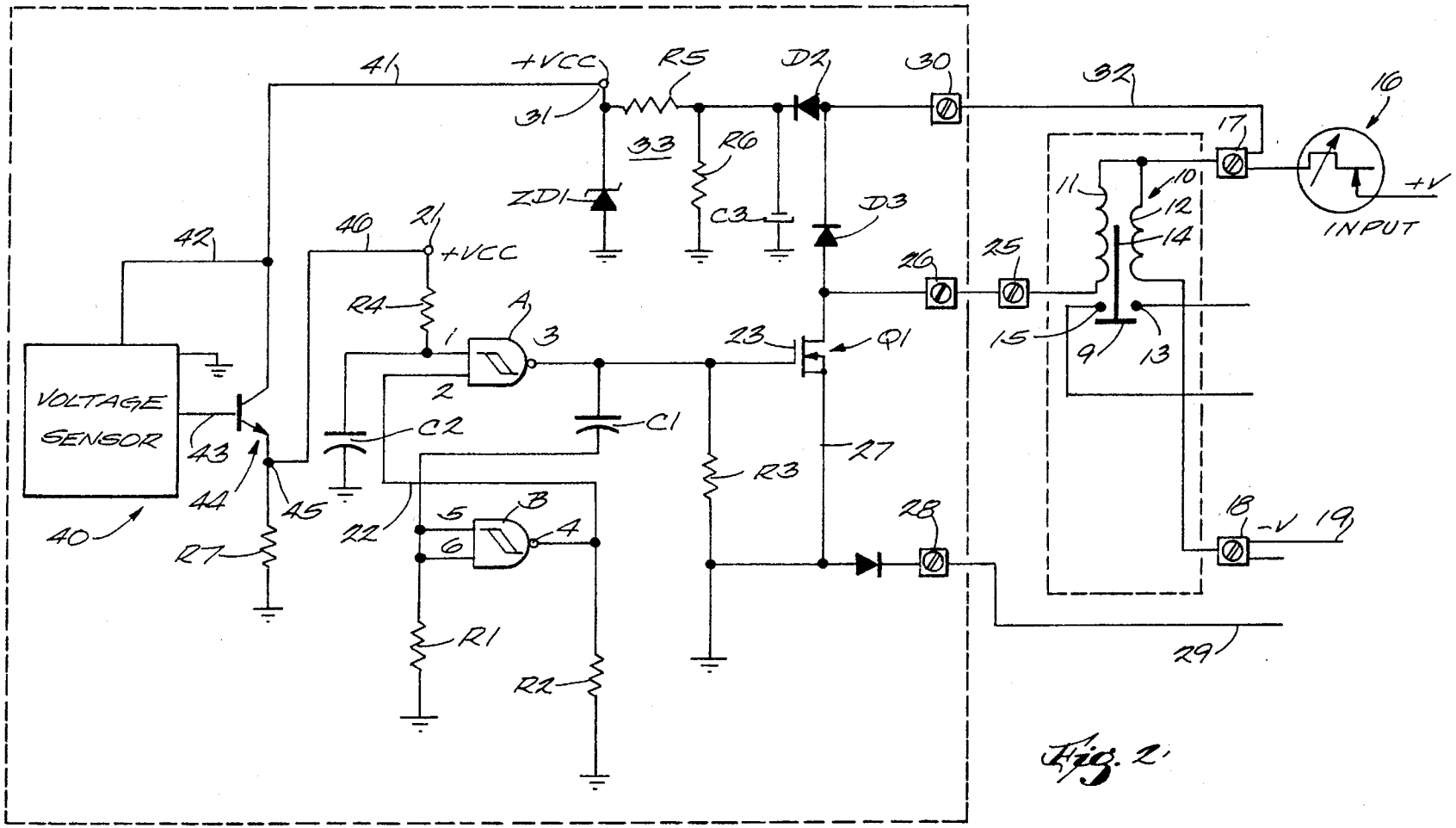
FIG. 2 shows an alternative embodiment of the controller.

A modification of the contactor controller heretofore described is depicted in FIG. 2. The FIG. 2 embodiment is characterized by not supplying any current to the contactor pull-in coil 11 unless the supply voltage on terminal 21 ($+V_{CC}$) is above an acceptable minimum voltage. The minimum voltage is the voltage which is at least high enough for the current to pull-in coil 11 to create a sufficiently strong magnetic field to pull-in contactor 10.

Most of the circuitry and the functions thereof which are shown in FIG. 2 are similar to FIG. 1. FIG. 2, however, is provided with a voltage sensor 40. In an actual embodiment, the voltage sensor 40 is implemented with a Motorola integrated circuit type MC33161D. Other voltage sensors could be used. The sensing circuit 40 is energized by the source voltage driving the current through thermostat 16. If the source is steady-state dc, there is no need to be concerned with filtering, so dc flows from the thermostat 16 to terminal 31 through line 32, diode D2 and resistor R5. Lines 41 and 42 supply power to voltage sensor 40. The sensor is operative to output a positive signal on line 43 only if the input voltage level on line 42 as delivered from thermostat 16 is above a predetermined value. If the input voltage is sufficiently high to assure that the coil will pull-in the contactor 10, the corresponding output signal on line 43 forward biases the base-emitter circuit of the transistor 44, thereby causing the transistor to conduct as a voltage follower using resistor R7 as an emitter resistor. The voltage developed at junction 45 is applied by way of line 46 to dc power input terminal 21. Thus, the pulsing circuit based on use of gates A and B as previously described is energized in the same manner and functions in the same manner as was explained in reference to the FIG. 1 embodiment.

As is evident in FIG. 2, the controller may be applied to thermostat 16 with full wave rectified dc for being filtered or smoothed with the filter circuit 33 comprised of electrolytic capacitor C3, resistors R6, R5 and Zener diode ZD1.

Figure 3:
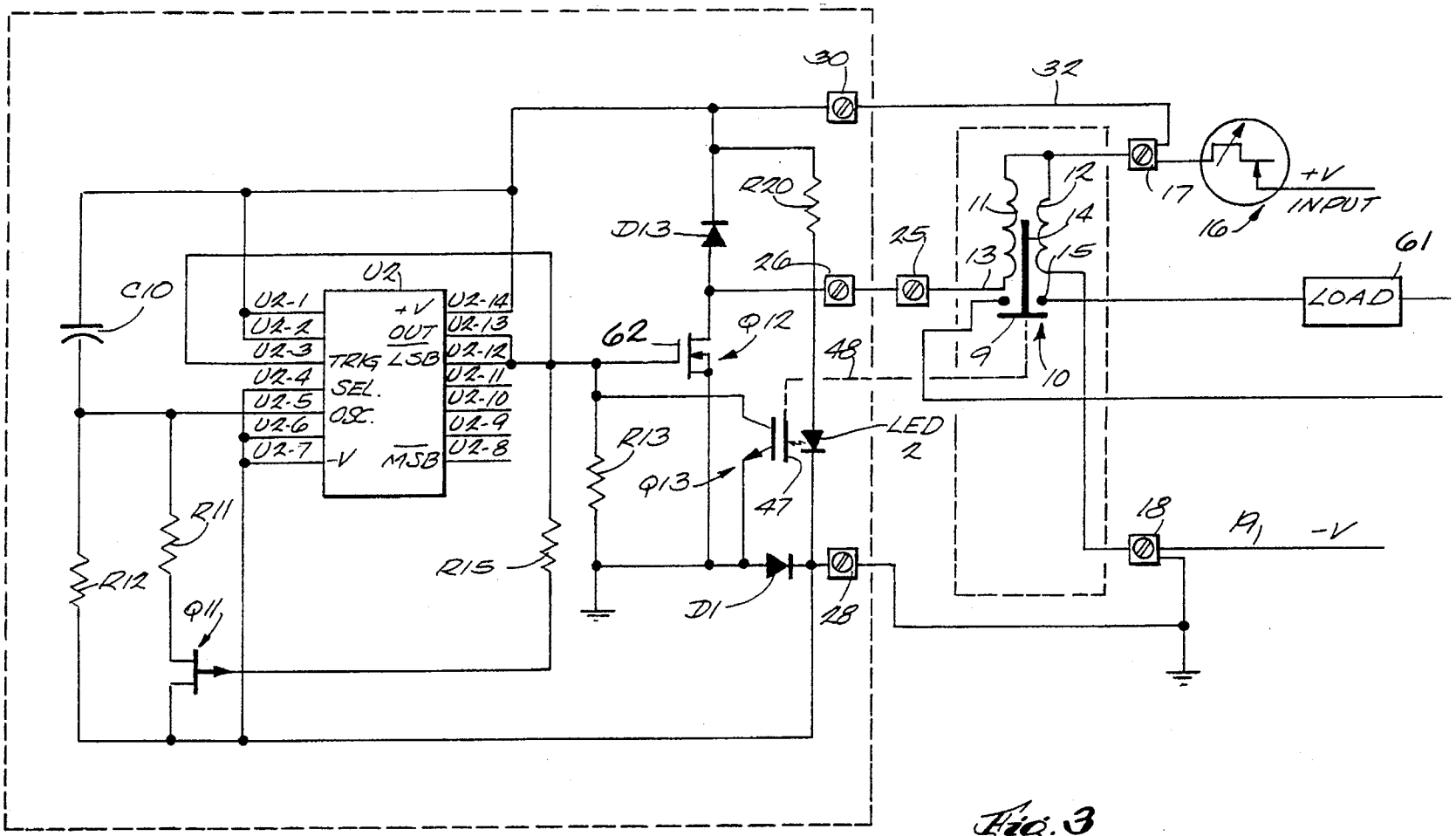
FIG. 3 is a modification of the controller wherein a programmable digital delay timer is used for generating pulses having a selected width or duration at a selected repetition rate and wherein pull-in of a load relay contactor results in generation of a feedback signal that terminates current pulses to the pull-in coil of the contactor.

The FIG. 3 embodiment of the controller is conceptually consistent with the preceding embodiments in that, when the circuitry is energized by closure of a first switching device such as thermostat 16, at least one short current pulse is fed through pull-in coil 11 of the contactor. In this embodiment, however, current pulses are fed at a selected repetition rate or with a delay between them until the contactor armature pulls in and seats. When the contactor seats, a signal is generated that turns off the current pulses which remain completely deenergized even though the thermostat 16 is conducting. As previously suggested by way of example and not limitation, the pulses may have a time-width of about 100 ms with a uniform delay or space between them of about 6 seconds. Of course, both of these values would change dependent on the size of the contactor. In the FIG. 3 embodiment, the current pulses to the pull-in coil 11 are generated with a programmable digital timer that is represented by the rectangle marked U2. In an actual embodiment, a type LS 7210 programmable digital delay timer is used and is available from LSI Computer Systems, Inc. of Melville, N.Y. Other programmable timers could be used.

In FIG. 3, components that are the same as those present in previously discussed embodiments are given the same reference numerals.

The controller shown in FIG. 3 is useful for controlling various dc electrical loads such as the load generalized by the rectangle that is so labeled and given the reference numeral 61. As is true of the previously discussed embodiments, the controller is ideal for controlling a refrigeration system such as is installed in a semi-trailer that transports perishable foods. Load 61 may be a refrigeration compressor motor.

Thus, the controller is energized from the semi-trailer tractor battery or other dc source from a line marked input +V. When the thermostat 16 senses in the refrigerated environment a temperature rise above its set temperature, the thermostat switches to a conductive mode.

Before going into detail about the programmable timer U2, assume that the thermostat 16 is conductive and U2 is energized, so it begins outputting the short pulses at a uniform repetition rate or delay from output pin U2-13 of timer U2. The pulses are applied to the gate 62 of field effect transistor (FET) Q12, thereby causing FET Q12 to become conductive in correspondence with each pulse applied to gate 62. The current pulses then flow through a circuit beginning at the positive dc input terminal 17 and continuing to contactor pull-in coil 11, Q12, diode D1, output terminal 18 to the negative side of the dc source by way of line 19, thereby causing the armature 14 to pull in under magnetic influence of the energized coil 11. If full armature pull-in is not successful on the first or ensuing pulses, possibly because of the dc source voltage being too low temporarily due to other loads being served by the battery, the output pulses from output pin U2-13 of timer U2 will continue. When pull-in of contactor armature 14 occurs, stationary contacts 13 and 15 of the contactor are bridged or connected by movable contacts 9. This completes the circuit which includes the load 61. If the load 61 is a refrigerator compressor motor, for instance, the motor would run until the temperature of the refrigerated compartment drops below the thermostat 16 setting, in which case the thermostat becomes non-conductive and the whole controller circuit is deenergized. Upon this event, armature 14 drops out.

The FIG. 3 controller features a timing circuit based on a programmable digital timer U2 and also features electromechanical feedback for terminating current pulse flow through pull-in coil 11 as soon as armature 14 reaches the limit of its stroke. The switch contacts 13, 15 remain-bridged, however, since the armature 14 is held under the influence of low-current-carrying holding coil 12. Feedback is accomplished in the FIG. 3 embodiment using a shutter 47. The shutter is shown positioned between a photosensitive transistor Q13 and light-emitting diode LED2 which is emitting light continuously as a result of being energized through R20 from terminal 30. Shutter 47 is mechanically coupled to armature 14 by means that are symbolized by dashed line 48. When armature 14 pulls in, shutter 47 is withdrawn from between photo-sensitive transistor Q13 and LED2, thus causing Q13 to switch to a conductive state. As a result, Q13 shunts the pulses from the output pin U2-13 of timer U2 that would otherwise cause FET Q12 to conduct. Inhibiting FET Q12 from conducting terminates current pulse flow through pull-in coil 11. Thus, no electric power is consumed by coil 11 after the armature 14 pulls-in and seats.

The timer U2 is programmable to set the pulse width or duration and the off time or delay between pulses by way of appropriate selected connections to pins U2-8 through U2-12. Pin U2-12 is the least significant bit (LSB), pin U2-11 is LSB+1, pin U2-10 is LSB+2, pin U2-9 is LSB+3, and pin U2-8 is the most significant bit MSB. Pins U2-8 through U2-12 are designated weighting factor inputs.

Type LS7210 programmable digital delay timer U2 is being used in the dual delay mode where in pins U2-1 and U2-2 are jointly connected to the positive side of a dc source, such as a battery or rectifier, not shown, of a semi-tractor pulling a refrigerated semi-trailer. The dual delay mode provides time delays for both turn on and turn off of output pin U2-13. Once turned on, the output remains on, as long as the trigger (TRIG) input pin U2-3 is at logical 0 level. Once turned off, the output remains off, as long as trigger input pin U2-3 is at logical 1 level. Other pins of timer U2 still to be identified are clock select pin (SEL) U2-4, oscillator (OSC) pin U2-5, external clock pin U2-6 which is not used, and negative line −V, pin U2-7. The positive voltage input +V is to pin U2-14.

An example of programming the timer U2 to produce nominally 100 ms duration pulses with a nominal time delay of 6.6 seconds between them is given as illustrative of programming timer U2. Persons skilled in the electronics art can generalize programming in the dual delay mode using the example being given here or by referring to the specification sheets of the manufacturer of the LS7210 timer or whatever digital delay timer is being used.

The time delay is set by Equation (1) where:

$$\text{delay} = \frac{(1 + 1023N)}{f} \qquad \text{Equation (1)}$$

where f is the oscillator (OSC) frequency and N is the weighting factor, which can be 0, 1, 2, 4, 8 and 16 depending on the logic level at pins U2-12, U2-11, U2-10, U2-9 and U2-8 respectively. In the illustrated configuration, pin U2-12 is the LSB and its state is changed from logical low to logical high level by the external circuit including transistors Q11, R11 and programming pins U2-1 and U2-2. Pins U2-1 and U2-2 are connected to the positive dc input line to effect the dual delay mode. When pin U2-12 goes low, the time delay is fixed by Equation (2):

$$\text{delay} = \frac{(1 + 1023 \times 1)}{f} \qquad \text{Equation (2)}$$

where f is determined by the RC time constant formed by R11, R12 and C10 with Q11 switching R11 in and out of the circuit at a speed determined by resistor R15, depending on the logical level of pins U2-12 and U2-13. When pins U2-12 and U2-13 are low, Q11 conducts and R12 is in parallel with R11 and in series with seat C10. The time constant TC1 is determined according to Equation 3:

$$TCI = \frac{R11 \times R12}{(R11 + R12)} \times C10 \qquad \text{Equation (3)}$$

For the sake of illustrating with actual numbers for clarity that comes from use of a concrete example, where R11 has a value of 15K ohms, R12 has a value of 200K ohms and C10 has a capacitance of 0.47 microfarads, TC1=6.6 ms. Since pin U2-12 is at a low logic level, the value of N(LSB) is one. Therefore, the time delay is according to previously stated Equation (3) where "f" is one/time or one/0.00656 seconds, and, therefore, the delay is equal to 6.6 seconds. This is the OFF time for the timer, in other words, the time between pulses when there is no output from pin U2-12 of the timer and FET Q12 is not conducting.

After expiration of TC1, the timer resets to the ON mode because pins U2-1 and U2-2 of timer U2 are always in a logical high state, since they are always at dc source or battery voltage and are, therefore, in the dual delay mode.

When output pin U2-12 of timer U2 switches to a logical high state, Q11 stops conducting so R11 is no longer effectively in parallel with R12. The time constant TC2 is then R11, C10. In this example, $TC2=0.2\times10^{6}\times0.47\times10^{-6}=$ 0.094 second or 94 ms, which is nominally 100 ms.

Timing accuracy is governed by the tolerances of the time constant circuit elements R11, R12 and C10. Also, when the pins U2-12 and U2-13 are in a high logical state, the value of the LSB is 0. So, to summarize, with the circuit parameters given, FET Q12 is ON for 94 ms and OFF for 6.6 seconds. Thus, contactor pull-in coil is energized for 94 ms and deenergized for 6.6 seconds until the armature 14 pulls in and seats after which coil 11 is, in a sense, disconnected from any dc supply, but the holding coil 12 keeps the armature pulled in.

Figure 4:
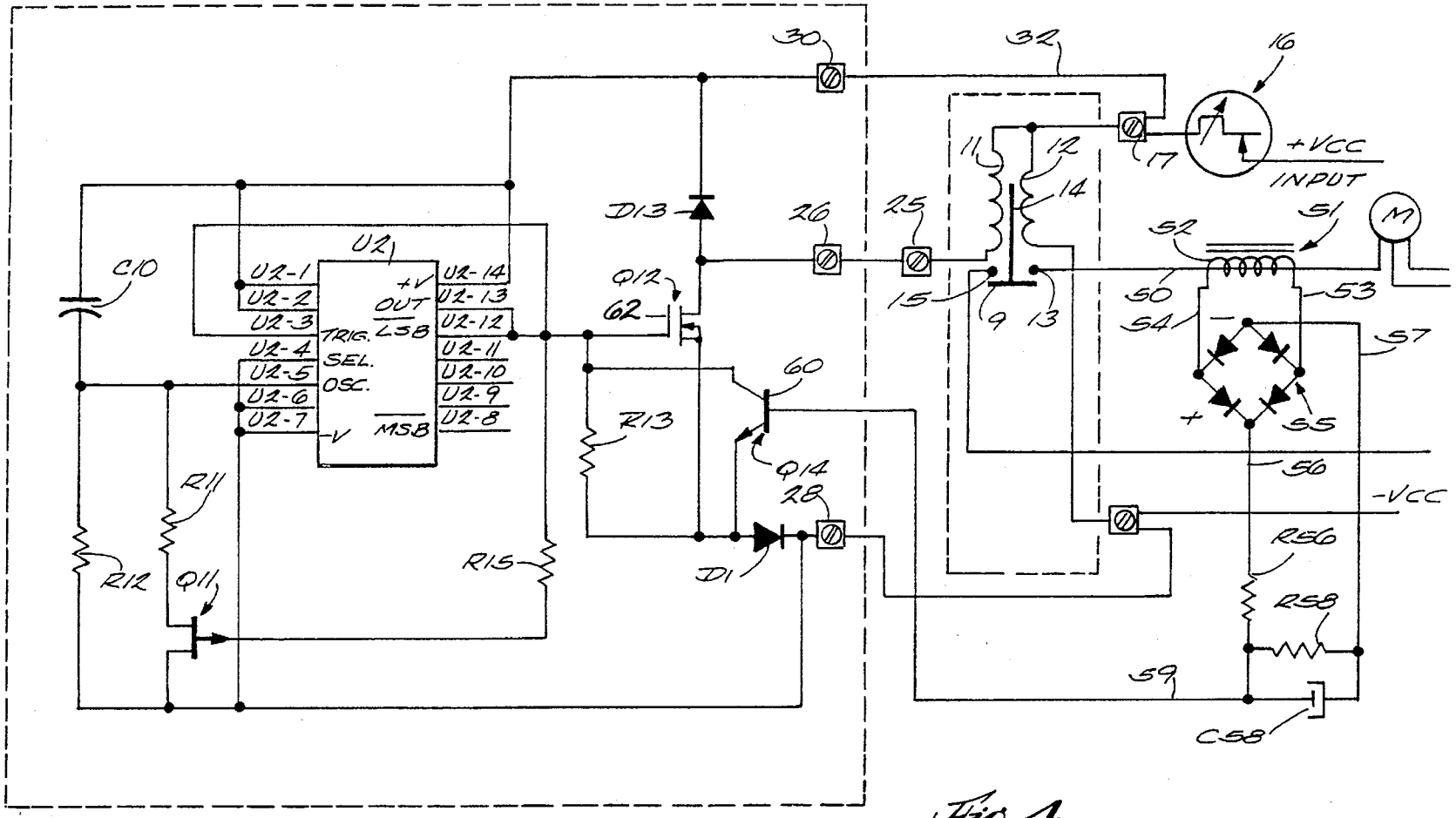
FIG. 4 is similar to FIG. 3 except for generating the feedback signal in a different manner.

The FIG. 4 embodiment is basically similar to the FIG. 3 embodiment, except that in FIG. 4 feedback for turning off the pulses that result in excitation of pull-in coil 11 is achieved by using current sensing means rather than an electromechanical method. Parts that are the same in the two embodiments are given the same reference numerals.

In FIG. 4, when armature 14 is up and seated by the first or a following current pulse, movable contact 9 bridges stationary contacts 13 and 15 and an ac load current flows in the lines. The load is exemplified in this example as one phase of a three-phase motor M. The holding coil 12 keeps the armature pulled in and seated until switch 16 (shown as a thermostat) opens. Secondary winding 52 of a current transformer 51 uses conductor 50 as its primary. The ac output lines 53 and 54 are input to a full wave rectifier 55, which has dc output lines 56 and 57. An electrolytic filter capacitor C58 is connected between positive output line 56 of the rectifier and a current limiting resistor R56 which is connected to the negative output of the rectifier. Thus, when there is a dc output from the rectifier incidental to the armature 14 having been pulled in, a dc signal is transmitted by way of line 59 to the base 60 of a pulse shunting semiconductor switch Q14. Resistor R58 is in parallel with capacitor C58, to facilitate discharge when the system is turned off. A signal on base 60 of Q14 switches Q14 to conduction. Switch Q14 thereby grounds gate 62 of FET Q12, so that the pulses delivered from the timer output pin U2-13 are shunted from the gate and Q12 stops conducting. Hence, pull-in coil 11 is not energized after armature 14 pulls in and seats.

The invention thus provides a number of different embodiments of a circuit for reducing the risk of damage to the pull-in coil caused by insufficient power to pull in the contactor. This goal is accomplished by reducing the total length of time during which current is applied to the pull-in coil, whether by sending a single short pulse of current to the coil or a number of pulses, or by detecting when the coil is pulled in.

Although preferred embodiments of the invention have been described in detail, such description is intended to be illustrative rather than limiting, for the invention may be variously embodied and is to be limited only by interpretation of the claims which follow.

What is claimed is:

1. An electronic controller for controlling operation of a contactor that comprises an armature which when in a pulled-in condition completes an electric circuit, and further comprises an electromagnetic pull-in coil which when conducting current above a predetermined magnitude pulls in the armature, and an electromagnet holding coil adapted for conducting current at least of sufficient magnitude for holding the armature in pulled-in condition, the controller including:

a first switching device having an input and an output and operative to connect and disconnect the input to and from a power source, a solid state switching device connected in a series circuit with said pull-in coil and said output of the first switching device, the solid state switching device having a control element responsive to an applied pulse signal by causing the solid state switching device to conduct for a duration corresponding to the width of the pulse signal, a timing circuit having an input coupled to the output of the first switching device and an output coupled to said control element of the solid state switching device, said timing circuit responding to power from the output of the first switching device by applying to said control element at least one pulse signal having a duration corresponding to the time required for said pull-in coil to pull-in said armature so as to convert said solid state switching device to a conductive state to energize said coil for a duration corresponding substantially to the pulse duration;

said timing circuit including:

first and second logic gates each having at least two inputs and an output, a first circuit comprised of a first resistor having an input end constituting the power input to the controller and a first capacitor connected in series, a point between the capacitor and first resistor being connected to one input of the first logic gate, a second circuit comprised of a second capacitor and a second resistor connected in series with the second capacitor and a point between the second capacitor and resistor connected to the two inputs of the second logic gate, the output of the second logic gate connected to the other input of the first logic gate, a third resistor connected to the output of said second logic gate and a fourth resistor connected to the output of the first logic gate, the first capacitor starting to charge when voltage is applied to the first resistor from said output of said switching device to thereby cause the output of the first logic gate to switch to a high logic voltage state for initiating conduction of the solid state switching device developing a positive voltage drop across said fourth resistor, said second capacitor starting to charge in response to the output of said first logic gate switching to a high logic voltage state to thereby cause said inputs of the second logic gate to be at a high logic level and the output of the gate to therefore be held at a low logic level until said second capacitor is charged to a predetermined voltage level, upon which event the output of the second logic gate switches to a high logic voltage state which is coupled to the other input of said first logic gate, to thereby cause said first logic gate to switch its output to a low logic voltage level for controlling said solid state switching device to switch to a nonconductive state.

2. The controller according to claim 1 wherein said first and second logic gates are NAND gates.

3. The controller according to claim 1 including:

a voltage sensor having a power input supplied from said output of the first switching device and a control signal output, a transistor switch having a control electrode connected to the control signal output, said transistor switch connected to said output of the first switching device and to said power input of said first resistor, said voltage sensor responding to said output voltage of said first switching device being high enough for driving enough current through the pull-in coil for the armature to pull in by the sensor producing an output signal that results in said control electrode causing said transistor switch to conduct and supply power to said controller power input.

4. An electronic controller for controlling operation of a contactor that comprises an armature which when in a pulled-in condition completes an electric circuit, and further comprises an electromagnetic pull-in coil which when conducting current above a predetermined magnitude pulls in the armature, and an electromagnet holding coil adapted for conducting current at least of sufficient magnitude for holding the armature in pulled-in condition, the controller including:

a first switching device having an input and an output and operative to connect and disconnect the input to and from a power source, a solid state switching device connected in a series circuit with said pull-in coil and said output of the first switching device, the solid state switching device having a control element responsive to an applied pulse signal by causing the solid state switching device to conduct for a duration corresponding to the width of the pulse signal, a timing circuit having an input coupled to the output of the first switching device and an output coupled to said control element of the solid state switching device, said timing circuit responding to power from the output of the first switching device by applying to said control element at least one pulse signal having a duration corresponding to the time required for said pull-in coil to pull-in said armature so as to convert said solid state switching device to a conductive state to energize said coil for a duration corresponding substantially to the pulse duration;

said timing circuit further comprising a programmable digital delay timer having a power input coupled to said output of the first switching device and having its pulse signal output coupled to said control element of the solid state switching device, said timer operating to output pulses having a width and duration corresponding to the time required for said pull-in coil to pull in said armature and to cause a uniform delay interval between successive pulses, and shunting means responsive to said pull-in coil having pulled in said armature by shunting the timer output pulses from said control element of the solid state switching device for the switching device to become nonconductive and terminate flow of current pulses through said pull-in coil.

5. The controller according to claim 4 wherein said shunting means comprises a photosensitive transistor connected to said control element of the solid state switching device, a light emitting diode (LED) proximate to said photosensitive transistor, a movable shutter disposed between said LED and the photosensitive transistor and means operatively coupling said armature and shutter for withdrawing the shutter from between said LED and the photosensitive transistor when the armature pulls in causing the transistor switches to a conductive state for shunting the pulses from the control element.

6. The controller according to claim 4 including:

a circuit that begins to conduct alternating current (ac) in response to said armature having pulled in, said shunting means comprising a current transformer in said circuit and a rectifier device having an alternating current (ac) input coupled to said current transformer and having a direct current (dc) output, and a semiconductor switch connected to the control element of said solid state switching device, said semiconductor switch having a control element coupled to said dc output of said rectifier and responding to a signal from the dc output of the rectifier by conducting for shunting the pulses from the control element of said solid state switching device.

* * * * *